United States Patent [19]

Corsette

[11] Patent Number: 4,503,997

[45] Date of Patent: Mar. 12, 1985

[54] DISPENSING PUMP ADAPTED FOR PRESSURE FILLING

[76] Inventor: Douglas F. Corsette, 6559 Firebrand St., Los Angeles, Calif. 90045

[21] Appl. No.: 502,272

[22] Filed: Jun. 8, 1983

[51] Int. Cl.[3] ..... B05B 11/00

[52] U.S. Cl. ..... 222/321; 222/385; 222/402.16; 141/20

[58] Field of Search ..... 222/321, 380, 383, 381, 222/385, 372, 402.16; 239/333, 331, 337; 141/20, 3

[56] References Cited

U.S. PATENT DOCUMENTS

| | | | |
|---|---|---|---|
| 3,211,346 | 10/1965 | Meshberg . | |
| 3,232,324 | 2/1966 | Sokol . | |
| 3,651,997 | 3/1972 | Venus . | |
| 3,995,666 | 12/1976 | Michaels . | |
| 4,050,613 | 9/1977 | Corsette . | |
| 4,218,198 | 8/1980 | Kutik et al. | 222/383 |
| 4,220,265 | 9/1980 | Shay . | |
| 4,271,875 | 6/1981 | Meshberg . | |
| 4,274,560 | 6/1981 | Cater . | |

*Primary Examiner*—Joseph J. Rolla
*Assistant Examiner*—Andrew Jones
*Attorney, Agent, or Firm*—Watson, Cole, Grindle & Watson

[57] ABSTRACT

A dispensing pump is adapted for pressure filling and includes a fluid filling passage which remains sealingly closed during pumping operation by the provision of an annular valve skirt in sealing engagement with a wall of the fluid filling passage, such skirt inwardly flexing during charging the container permitting the charged fluids to by-pass the valve and enter the container. The valve skirt depends from either the plunger head or from the plunger. When depending from the plunger, the valve skirt functions as a guide element for the plunger head together with a plunger head retention bead which cooperates with a pump body retention bead in limiting the upward movement of the plunger head to a predetermined extent. These guide members serve to isolate the plunger against the influence of lateral or eccentric forces applied against the plunger head during its reciprocation. And, the plunger may be capped with a wall surface defining a complementary contour to that of the upper end of the piston which it faces to facilitate expelling of product from the accumulation chamber after the end of the plunger downstroke as this surface first bottoms against the upper end of the piston.

14 Claims, 4 Drawing Figures

DISPENSING PUMP ADAPTED FOR PRESSURE FILLING

RELATED APPLICATION

This application relates to U.S. Ser. No. 502,274 filed June 8, 1983 as a continuation-in-part of U.S. Ser. No. 121,223, filed Feb. 13, 1980 now U.S. Pat. No. 4,402,432.

BACKGROUND OF THE INVENTION

This invention relates generally to a dispensing pump of the pressure accumulating type, and more particularly to such a pump for dispensing product from a container having a low pressure gas therein for assisting in charging the pump chamber, the container being rechargeable with pressurized product outwardly of the plunger head.

Various dispensing devices for especially aerosols are capable of being refilled or recharged with pressurized product. These dispensing devices operate simply as control valves for expelling the pressurized product upon manual depression of a spray button, and the method of filling most widely used is known as pressure filling. The product to be dispensed is pressurized with a propellant liquid either of the type which vaporizes very rapidly when the product is at atmospheric pressure, or of the type in which the propulsion of the product is effected by maintaining the liquid composition in a container under the pressure of a permanent gas, such as nitrogen or carbon dioxide. The pressure filling technique is preferred over the alternative "cold-filling" method, and the use of a soluble or insoluble gaseous propellant, such as carbon dioxide, nitrous oxide or the like, for aerosol dispensers is much preferred and desirable over the use of liquid propellant gases such as propane and butane since the compressed gases are not incompatible with fragrances or sensitive drug products to be dispensed.

All of these aerosol dispensers are hermetically sealed to the container which offers many advantages over the known pump sprayers requiring the container to be vented to atmosphere. Thus, those products which cannot tolerate the presence of air which could result in the oxidation of the product, such as certain sensitive drugs, can be safely and effectively dispensed using one of the many types of aerosol dispensers on the market.

To satisfy a variety of needs, and as an alternative to the aforementioned valve control-type aerosol dispensers, a pump-type dispenser is disclosed in U.S. Pat. No. 3,211,346 which eliminates the need for venting the container since the material therein is under the pressure of an inert gas which ensures flow of the material into the pump chamber. However, this throttling-type pump suffers from the same disadvantages in use as any other pump of its class in that the discharge is slow to close upon the release of pressure on the finger actuator thereby causing unwanted dribbles and drips at the discharge, and air is introduced into the pump chamber as the pump volume expands upon release of finger pressure. Besides, no provision is made for charging or refilling the container with the dispenser in place.

A subsequent pump development is disclosed in FIGS. 6 and 7 of U.S. Pat. No. 4,271,875 in which a pressure build-up sprayer, also having no container vent, makes use of a compressed gas such as nitrogen for forcing product from the container up through the dip tube and into the pump chamber during the piston upstroke. Provision is made for filling this pump dispenser as pressurized fluids are injected from outside the pump chamber via a flexible gasket. However, such a pump structure possesses none of the advantages of my manual actuated dispensing pump, U.S. Pat. No. 4,050,613, on which the present application is based. For example, as pointed out in my earlier patent, the unitary plunger unit performs, in cooperation other components, the multiple functions of a pump cylinder, a piston for the pressure accumulation chamber, and a pressure actuated discharge valve. And, the unitary plunger of the aforementioned U.S. application Ser. No. 121,223 further performs the function of a container vent valve and, as set forth in the aforementioned related CIP application, the provision of a piston interfacing surface on the upper end of the plunger allows the plunger head to continue to expel product from the accumulation chamber after the end of the plunger downstroke. Furthermore, in that CIP application, the container vent valve can be disposed on the plunger head so as to provide a bearing member together with the retention bead on the cylindrical portion of the plunger head for resisting lateral and eccentric forces which may be applied to the plunger head so as to thereby isolate the plunger from the influence of those forces permitting it to respond without restraint in opening and closing the discharge. All these features of my prior and related developments have now been incorporated into an unvented dispenser of the pressure accumulating type which is adapted to be pressure filled.

SUMMARY OF THE INVENTION

It is therefore an object of the present invention to provide a manually actuated dispenser of the pressure accumulating type capable of being pressure filled with fluids quickly and efficiently, and at the same time possessing all the advantages of my earlier and related developments of a container vented pressure build-up sprayer.

Another object of this invention is to provide such a dispenser wherein an annular skirt having a flexible lip seal extends from either the plunger or the plunger head of the pump for closing a filling passage during plunger reciprocation, such passage being defined by an opening in the pump body and an annular wall surrounding a stationary piston on the pump body through which the free flow of fluid into the container is permitted while being pressure filled, such lip seal being flexed away from the annular wall only under pressure during filling.

A further object of the present invention is to provide such a dispensing pump as having an anti-cocking plunger head feature for isolating the plunger against the influence of forces exerted laterally or eccentrically against the plunger head during reciprocation, so as to permit the plunger to freely float without restraint in response to spring force from below and hydraulic force from above during its opening and closing of the discharge.

A still further object of the invention is to provide such a pump wherein the plunger has an interfacing contour at the upper end thereof which permits the plunger to bottom against the upper end of the piston before the end of the plunger head downstroke to thereby permit the plunger head to continue to expel product from the accumulation chamber before the end of its downstroke and the commencement of plunger upstroke which closes the discharge.

Other objects, advantages and novel features of the invention will become more apparent from the following detailed description of the invention when taken in conjunction with the accompanying drawings.

DETAILED DESCRIPTION OF THE INVENTION

Figure 1:
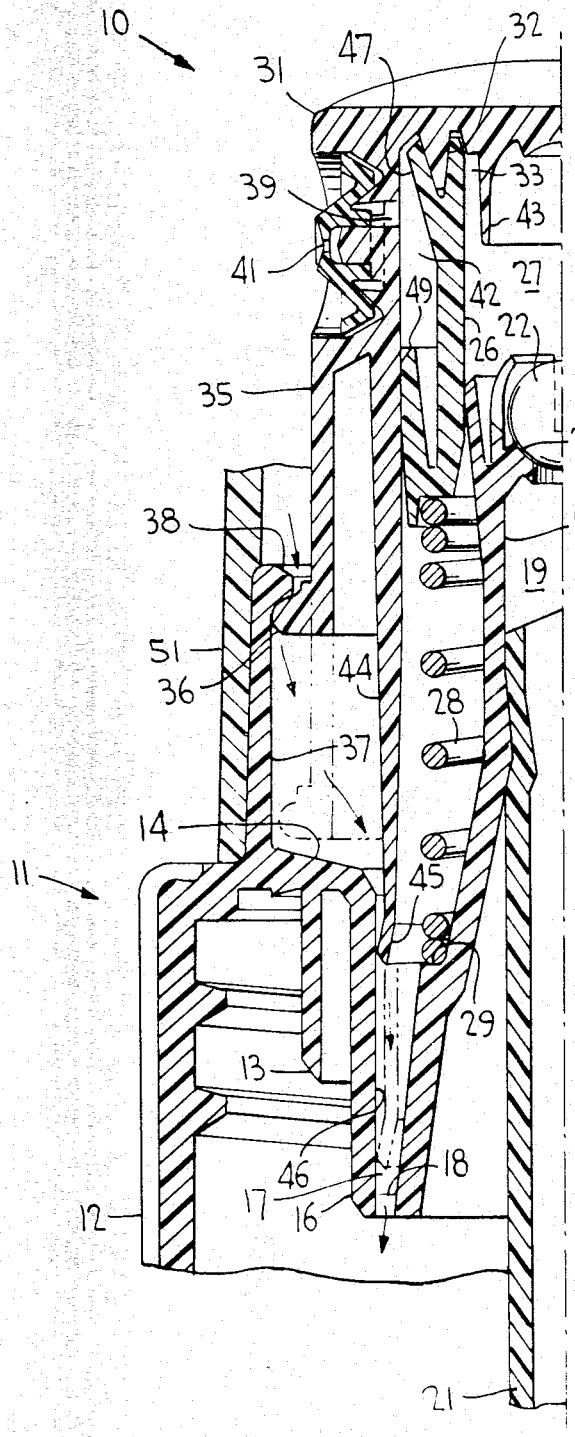
FIGS. 1, 2, 3 and 4 are half vertical sectional views of embodiments of a pressure pump according to the invention adapted for pressure filling.

Turning now to the drawings wherein like reference characters refer to like and corresponding parts throughout the several views, pump assembly 10 of the FIG. 1 is essentially the same as pump 10 shown in FIG. 1 of the aforementioned CIP application except that the present pump has no container vent. Thus, the assembly includes pump body 11 with an integrally formed closure cap 12 adapted for fluid tight securement on the neck of the container (not shown) of pressurized product to be dispensed. The pump assembly can be applied to the container filled with a product having added thereto a compressed gas such as carbon dioxide, nitrous oxide or the like, or can be positively charged (in a manner to be hereinafter described) on the filling line after filling the product with a container and after applying the pump assembly to the container whether by screw threaded engagement or by typical aerosol-type ferrule attachment, a snap-on flange or other type securement. And, an annular sleeve 13 depends from an upper wall 14 of the pump body and extends into engagement with the container neck for enhancing the fluid tight seal between the pump body and the container.

A stationary, hollow upstanding piston 15 is integrally formed on wall 14 via an annular wall 16 which is spaced from and surrounds the base of the piston to therewith define a fluid filling passage 17 through which the container is charged or pressure filled. A charging port 18 which also functions as a sump drain is located in the pump body at the bottom end of passage 17 through which fluids enter the container during charging and refilling. This port is positioned beyond the end of the plunger head downstroke to avoid being opened by the lip seal during reciprocation.

The piston is hollow and defines an inlet passage 19 into which a conventional dip tube 21 is secured in any normal manner, the tube having its lower end extending into the product to be dispensed from the container. A ball check valve 22 and ball seat 23 are provided at the upper end of the piston for valve controlling the inlet, and a plurality of ball retention fingers 24 surround the ball check valve at the upper end of the piston for permitting it to unseat during the suction stroke. And, the upper end of the piston terminates in an annular lip seal 25 which flares slightly outwardly and which is substantially inflexible.

An annular plunger or accumulator 26 having an internal bore therethrough snugly slidably receives and reciprocates on the stationary piston to therewith define a variable volume pump chamber 27. A return spring 28 compressed between a shoulder 29 of the pump body and the bottom end of the plunger resiliently urges the plunger upwardly toward a fully raised position above the pump body as shown in FIG. 1, and normally maintains it in that position.

A plunger head 31 has a downwardly directed blind socket 32 which snugly slidably receives plunger 26 and defines therewith an enclosed variable volume accumulation chamber 33 in open communication with pump chamber 27. This accumulation chamber has an appreciably larger diameter than the pump chamber, and the annular upwardly presented end of the plunger is exposed to downward fluid pressure within the accumulation chamber in opposition to the upward thrust of return spring 28.

The plunger head is conformed to present an upwardly directed finger piece 34 so that intermittent finger pressure conveniently applied to it may be transmitted to the plunger for producing reciprocation thereof on stationary piston 15, each depression of the plunger being yieldably resisted by spring 28 which returns the plunger to its fully raised position each time finger pressure on the head is relieved.

The plunger has an outer, annular depending skirt or cylindrical portion 35 terminating in a radially outwardly extending retention bead 36 having an outer diameter permitting the plunger head to be guided as it slides along the inner surface of an upstanding collar or cylindrical portion 37 on the pump body. The upper end of collar 37 has a radially inwardly extending retention bead 38 which cooperates with bead 36 for limiting upward movement of the plunger head at a predetermined position. One or both retention beads 36, 38 may be provided with open axial slots or grooves (not shown) through which fluids may be charged into the container in a manner to be described in more detail hereinafter.

The plunger head includes a discharge passage 39 which terminates in a discharge orifice 41 and which extends from a discharge chamber 42 defined by the annular space between the plunger and plunger head. Thus, dispensed product is conveyed through this discharge path, as thereby defined, from the accumulation chamber into the atmosphere during pumping operation, as the discharge path opens into the blind socket below the blind upper end of the plunger at a location such that this upper end is normally covered by the plunger when the latter is projected into its fully raised position as in FIG. 1 into the blind end of socket 32 by spring 28.

The underside of the plunger head carries a contoured surface 43 as an integral part of the head and projects into the pump chamber partially displacing the volume therein. This contoured surface is shaped to match the contour at the upper end of the piston, including the ball check valve and ball retention fingers as well as lip seal 25. Thus, the upper end of the piston and the opposing inner end of the plunger head are complementarily contoured so that when brought into face-to-face contact during a depression of the head, before the dispensing operation, the pump chamber may be primed if necessary by expelling any accumulated air therein through the discharge as that air is compressed and acts on the larger diameter accumulation chamber so as to shift the plunger relative to the discharge for the opening of same.

An annular valve skirt 44 depends from the plunger head and terminates in an annular lip seal 45 which sealingly engages inner surface 46 of wall 16 throughout plunger head reciprocation. This inner surface is defined by a straight cylinder which lies coaxial with the central axis of the pump body, so that passage 17 remains closed by the lip seal throughout the pumping operation. The present pump assembly is therefore a closed system since the contents of the container are under the influence of a compressed gas which ensures rapid flow thereof into the pump chamber without requiring venting of the container. Thus, where it is desired to prevent contamination of product to be dispensed such as fragrances and sensitive drugs, compressed gas such as carbon dioxide or nitrous oxide can be utilized for this purpose with the pressure selected at a value, depending on the nature of the product to be dispensed, only sufficient to move the product from the container to the pump chamber The upper end of the plunger or accumulator 26 has an outwardly extending flange 47 which is seated on the outer surface of a ring 48, depending from the upper end of the plunger head, in the fully raised and discharge valve closing position of the plunger of FIG. 1. The lower end of the plunger is reversely bent to define a lip seal 49 in sealing engagement with the inner surface of skirt 44, and delimiting discharge chamber 42. With such an arrangement, the terminal end of lip seal 49 lies below discharge passage 39 so that only a slight relative shifting between the plunger and the head opens the discharge as flange 47 is moved away from ring 48. A quick opening discharge is therefore made possible.

It will be seen that the pump assembly as aforedescribed is structured essentially the same as the pump assembly of my CIP application mentioned above, except that the present pump assembly comprises a closed system which requires no container venting. Thus, plunger head 31, together with its elements 35 and 44, is coaxial with the axis of the pump body includings its elements 15, 16 and 37, throughout plunger head reciprocation. Retention bead 38 and lip seal 45, both on the plunger head, function as aligning elements as they respectively glide along the inner surfaces of collar 37 and wall 16. Thus, the plunger head is permitted to reciprocate axially between stop limits while being maintained with its axis congruent with the pump body axis including especially collar 37, passage 17 and the stationary piston portions. With this lateral axial control, the plunger head can experience various non-axial forces without cocking its axis, or otherwise losing axial congruency. Therefore, the mis-application of lateral or eccentric forces to the plunger head during reciprocation is prevented from transmitting any bias or restraining force to the plunger. Thus, the plunger, which functions as the discharge valve element, is rendered free floating between the spring force below and the hydraulic force above and is not restrained against movement in response to these forces.

An example of the effect of lateral or eccentric forces on the plunger head is the action wherein the lateral or eccentric forces thereon induce a frictional load between the plunger and its valving elements which can permit the plunger to be momentarily held open at the end of the plunger downstroke with a small quantity of product remaining in the discharge path. When the actuating force on the head is relieved, even slightly, the frictional holding force or brake is relaxed. This then causes the spring to shift the plunger immediately to its closed position. Thus, the small amount of product which had been left in the discharge path at the end of the plunger discharge stroke is now suddenly purged at the start of the plunger intake stroke as the plunger closes in response to spring pressure. This unexpected discharge at the start of the recharge stroke is at least inconvenient and should be avoided. In accordance with the invention, since the plunger cannot be partially or wholly restrained by frictional engagement due to opposing force couples or lateral pressure, it will respond continuously and promptly in the intended operating mode in balance between the hydraulic pressure and opposing spring force.

The operation of the present pump assembly is essentially the same as that described in the aforementioned related applications, and in my prior U.S. Pat. No. 4,050,613, except that the product within the container is under the influence of a compressed gas. Thus, at the end of the plungr discharge, the ensuing plunger upstroke with the discharge closed expands the pump chamber and creates a partial vaccuum therein so that the pressure of the compressed gas will force the product through the dip tube and into the pump chamber while unseating the inlet ball check valve. In the container, the product to be dispensed may have solubilized therein a portion of the compressed gas with a headspace therein containing the remainder of the compressed gas. Thus, product within the container will remain under the influence of the compressed gas until emptied. And, the hydraulic discharge pressure within the pump chamber, produced during downward plunger reciprocation, must exceed the combined force of the return spring and the internal pressure within the container to effect discharge opening as this hydraulic pressure creates a discharge opening pressure acting within the accumulation chamber. Flange 47 at the upper end of the plunger defines a positively sealed discharge valve capable of withstanding container pressures up to the design discharge pressure of the present pressure build-up spray pump.

And, the present pump assembly can be applied to a container filled with a product having a compressed propellant gas therein, or it can be positively charged on the filling line after filling and after applying the sprayer to the container. A charging head 51, such as that conventionally used on aerosal filling lines, is partially shown in FIG. 1 and may be engaged over the pump assembly in a sealed manner at a convenient location such as shown in the drawing. The heavy arrows indicate the charging path of fluids as through the grooves of the retention beads, or by depressing the discharge head to disengage the retention beads should grooves not be provided. Normally, the discharge head will be depressed mechanically or by charging pressure. Annular lip seal 45 which sealingly engages inner surface 46 of wall 16 normally prevents egress of contents from the container, whether liquid or gas, and including contents under a positive gas pressure. However, this lip seal is sufficiently resilient so that, during charging, the charge pressure above seal 45 over comes the pressure within the container so as to by-pass the lip seal causing it to inwardly flex away from surface 46 allowing the charging fluids to enter the container through ports 18. After charging, higher pressure acting against the inner surface of lips seal 45 maintains it in sealing engagement against members 46, as the pressure above this valve returns to atmospheric pressure when the charging device is removed.

Figure 2:
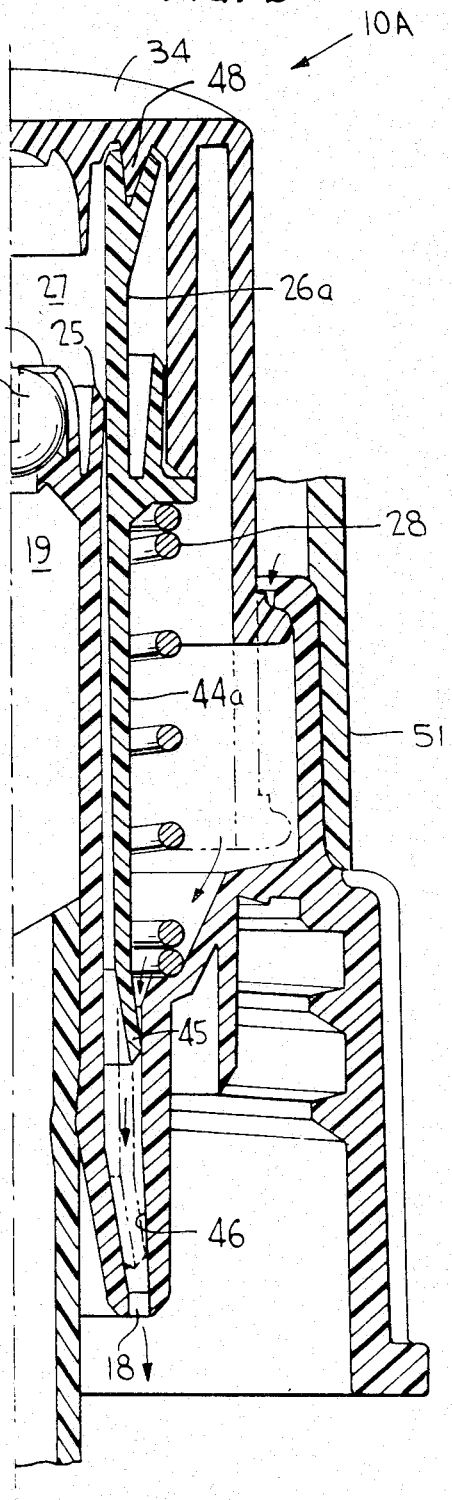

Pump assembly 10A, shown in FIG. 2, is essentially the same as pump assembly 10 so that like elements will be represented by the same reference numerals. However, in this embodiment, plunger **26*a* is not rendered free floating as described in FIG. 1, since it includes a skirt 44***a* which terminates in seal 45. Otherwise, however, the pump assembly functions the same as that described with reference to FIG. 1, and the container may be charged or filled with the use of a charging device 51 as shown by the heavy arrows indicating the charging path. Thus, the lip seal 45 will flex inwardly away from surface 46 during charging allowing fluids to enter the container through port 18, and will sealingly close against surface 46 when the charging device is removed.

Figure 3:
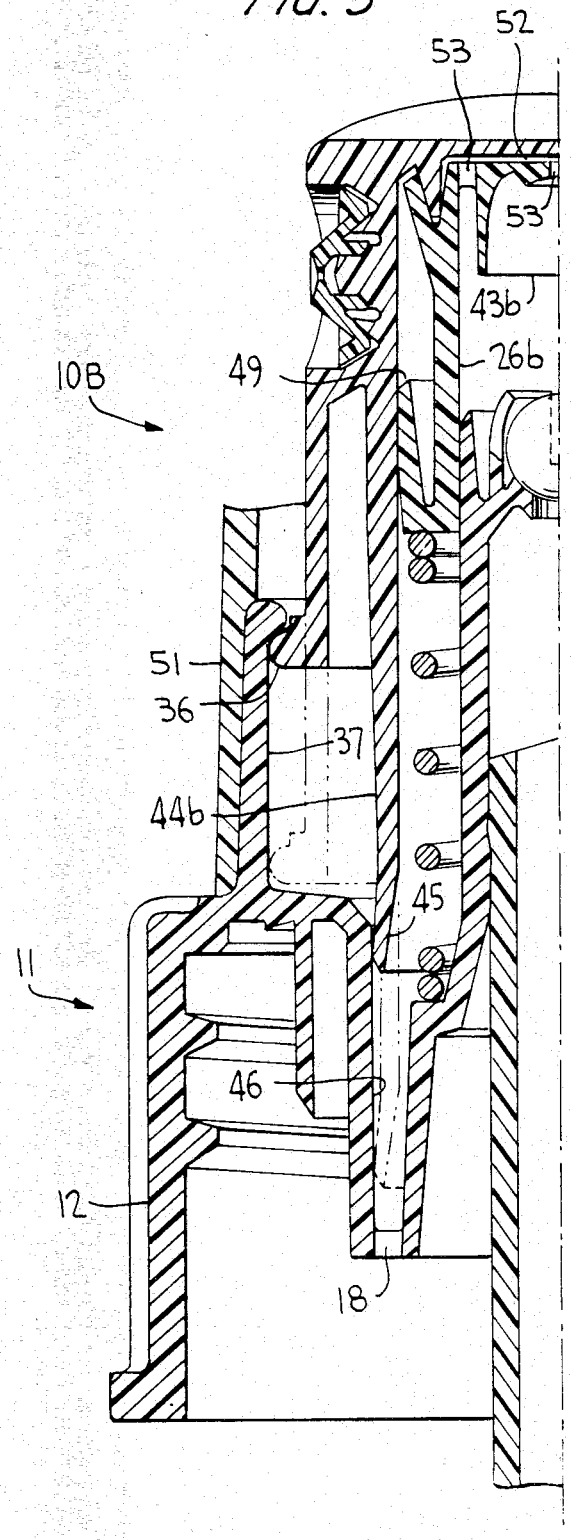

Pump assembly 10B shown in FIG. 3, is likewise essentially the same as that of assembly 10, except the plunger 26*b* is structured differently at its upper end. In addition to its free floating characteristic allowing it to reseat itself under the plunger head at the end of the plunger downstroke and before the ensuring plunger recharge stroke to avoid a discharge spurt after recharing commences, product is assured of being purged from the accumulation chamber before commencement of the recharge stroke. For this purpose, an interfacing contoured surface 43*b*, identical to surface 43 of FIG. 1, is provided at the upper end of the plunger as an integral part thereof. This surface includes a cover wall slightly spaced as at 52 from the underside of the plunger head, the cover wall having at least one through ports 53 for maintaining the open communication between the pump chamber and the accumulation chamber. Thus, upon plunger head depression, contoured surface 43*a* bottoms against the stationary piston and ball check valve before the plunger head reaches the end of its discharge stroke. The hydraulic pressure in the accumulation chamber upon plunger head depression maintains the head slightly spaced from the plunger during downstroke of the head so that, as the downstroke continues, the head is urged downwardly against the hydraulic pressure by the continuing finger force expelling the product above the plunger as part of the normal discharge stroke. Thus, "after spray" is avoided by mechanically assisting the plunger closing action at the end of the discharge stroke to thereby avoid any dribbling or dripping of product through the discharge at the end of the discharge stroke.

On the other hand, with contoured surface 43 carried on the underside of the plunger head as in FIG. 1, this interfacing contour of the head projects into the open upper end of the plunger so that the head interior bottoms against the upper end of the stationary piston and ball check members at the end of the discharge stroke. Thus, it is possible to exercise the discharge stroke at a velocity producing a pumping rate in excess of the orifice 41 discharge capacity at the control design pressure. The interfacing contour may thus reach the bottom of the discharge stroke while the plunger is still in a discharge valve open mode, displaced from the seat in the head, and continuing the discharge at rated pressure, expelling the accumulated product as the spring force returns the accumulator to its seated, valve closed position against the interior of the head. This continued discharge after the valve closes is referred to above as "after spray."

In the FIG. 3 embodiment, the plunger member without a depending skirt and with the interfacing air displacement integral contour becomes a free floating member responding to the opposing hydraulic and spring forces plus normal frictional factors. The plunger head carries annular skirt 44*b* with its lip seal 45 in sealing engagement with inner surface 46 of passage 17, to thereby function in not only keeping this passage closed during pumping operation but also serving as an alignment guide cooperating with head retention bead 36 as bearing members spaced apart axially to resist lateral or eccentric forces applied to the head, and to isolate such forces from the accumulator. Thus, each element of the pump assembly which slides relative to its confronting element is held with its axis congruent with all other cooperating elements to thereby eliminate detrimental counter-productive couples which may mitigate the performance of the assembly to an objectionable extent.

Figure 4:
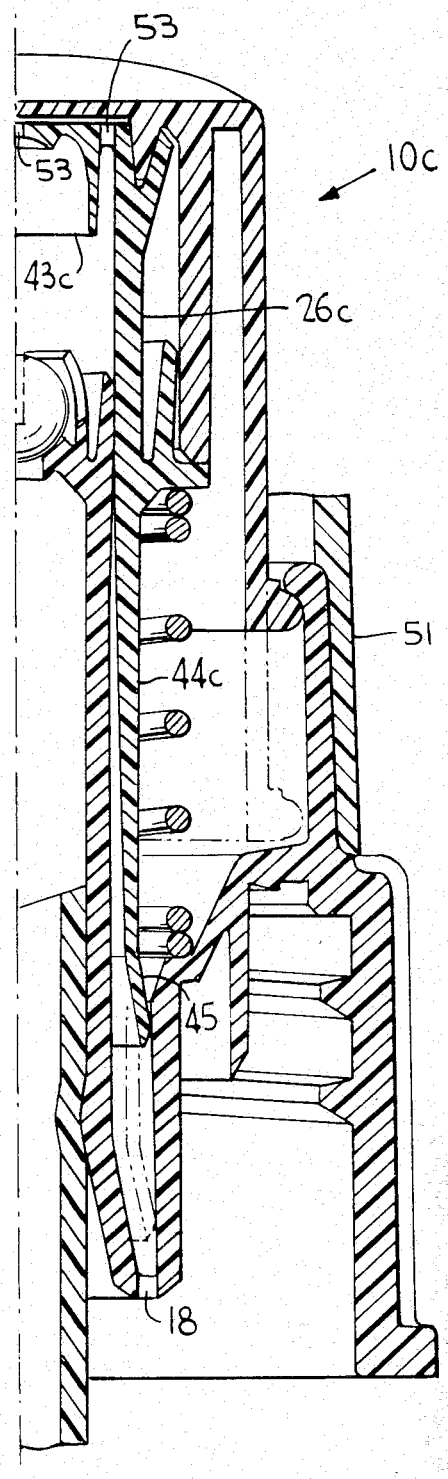

Pump assembly 10C of FIG. 4 compares with the FIG. 2 pump assembly except that skirt 44*c* extends from plunger 26*c* for closing passage 17 as aforedescribed. However, contoured surface 43*c*, identical to surface 43*b* of FIG. 3, is provided at the upper end of plunger 26*c* as an integral part thereof and functions in the identical manner as that described with reference to FIG. 3.

From the foregoing it can be seen that the plunger and plunger head of the aforedescribed pump assembly embodiments are the same as and are interchangeable with the plungers and the plunger heads of like embodiments of the aforementioned CIP application. And, the pump body of the several embodiments herein described need be modified relative to the pump assemblies of the CIP application only to the extent necessary to render the present assemblies a closed system to be utilized with a pressurized container requiring no container venting.

Obviously, many other modifications and variations of the present invention are made possible in the light of the above teachings. It is therefore to be understood that within the scope of the appended claims the invention may be practiced otherwise than as specifically described.

What is claimed is:

1. A dispensing pump of the pressure accumulating type, comprising a pump body having an upstanding stationary piston, said body being adapted for securement in a fluid tight manner on a container of product to be dispensed, reciprocable plunger means comprising an annular plunger resiliently urged into a fully raised position above said pump body and being mounted on said piston for reciprocation to define therewith a variable volume pump chamber, a valve controlled inlet passage in said piston, said plunger means further comprising a plunger head slideably disposed on said plunger for reciprocation and having means defining a variable volume accumulation chamber in open communication with said pump chamber, said head having a discharge passage adapted to be opened and closed upon relative movement by said plunger in response to a change in pressure within said pump chamber, means for limiting upward movement of said plunger head at a predetermined position wherein said plunger in said fully raised position functions as a valve for closing said passage, said body including a refill opening and an annular wall surrounding said piston and therewith defining together with said opening a refill passage for pressurized product, a skirt depending from said plunger means for reciprocation together therewith, said skirt having an annular resilient lip seal thereon in sealing engagement with an inner surface of said wall for closing said passage and for guiding said plunger means during reciprocation thereof, said lip seal being deflectable away from said inner surface for thereby opening said passage in response to a charge of pressurized product applied to the outer surface of said lip seal during a charge operation.

2. The dispensing pump according to claim 1, wherein said skirt depends from said plunger.

3. The dispensing pump according to claim 1, wherein said skirt depends from said plunger head.

4. The dispensing pump according to claim 2, wherein said refill opening is positioned beyond the end of the plunger downstroke to avoid opening by said lip seal during reciprocation thereof.

5. The dispensing pump according to claim 3, wherein said refill opening is positioned beyond the end of plunger head downstroke to avoid opening by said lip seal during reciprocation thereof.

6. The dispensing pump according to claim 1, wherein said plunger head and said pump body are provided with relatively telescoping cylindrical portions having retention beads thereon for limiting said upward movement of said plunger head.

7. The dispensing pump according to claim 3, wherein said pump body includes a collar surrounding said piston, said plunger head defining a first annular bearing element in sliding engagement with said collar during plunger head reciprocation, said limiting means being located on said bearing element and on said collar, and said lip seal on said skirt defining a second bearing element, said bearing elements acting to resist any lateral or eccentric forces applied to said head during its reciprocation to thereby isolate said forces from said plunger permitting it to respond without restraint during said movement in opening and closing said discharge passage.

8. The dispensing pump according to claim 1, wherein wall means having ports therein is provided at the upper end of said plunger confronting the upper end of said piston and being complementarily contoured thereto, said wall means permitting said head to continue to expel product through said discharge passage upon depression of said head after said wall means bears against said upper end of said piston at the end of the plunger downstroke, before said plunger moves into its discharge closing position.

9. The dispensing pump according to claim 3, wherein wall means having ports therein is provided at the upper end of said plunger confronting the upper end of said piston and being complementarily contoured thereto, said wall means permitting said head to continue to expel product through said discharge passage upon depression of said head after said wall means bears against said upper end of said piston at the end of the plunger downstroke, before said plunger moves into its discharge closing position.

10. A dispensing pump comprising a pump body sealingly mounted on a container of flowable product to be dispensed, said body including a stationary piston thereon having a valve controlled inlet passage therein, plunger means having a valve controlled discharge passage and being mounted for reciprocation on said piston to therewith define a variable volume pump chamber, said body further having a port therein and an annular wall surrounding said piston to therewith define a filling passage which includes said port permitting the free flow of fluids into the container while being pressure filled, a flexible annular lip on said plunger means normally sealed against said wall for closing said filling passage during plunger means reciprocation, said lip being flexed away from said wall only under pressure during filling to thereby permit the fluid to flow into the container.

11. The dispensing pump according to claim 10, wherein said plunger means comprises an annular plunger resiliently urged into a fully raised position and mounted for reciprocation on said piston to therewith define said pump chamber, said plunger means further comprising a plunger head slidably disposed on said plunger and including said discharge passage adapted to be opened and closed by said plunger during movement in response to a change in pressure within said chamber, telescoping cylindrical portions on said body and on said plunger head having means for arresting the upward movement of said head, said lip being located on said head and defining a bearing element in engagement with said wall, and said head cylindrical portion defining another bearing element in engagement with said body cylindrical portion, said bearing elements acting to resist any lateral or eccentric forces applied to said head during its reciprocation to thereby isolate said forces from said plunger permitting it to respond without restraint during said movement in opening and closing said discharge passage.

12. The dispensing pump according to claim 10, wherein said plunger means comprises an annular plunger resiliently urged into a fully raised position and mounted for reciprocation on said piston to therewith define said pump chamber, said plunger means further comprising a plunger head slidably disposed on said plunger and including said discharge passage adapted to be opened and closed by said plunger during movement in response to change in pressure within said chamber, said lip being located on said plunger.

13. The dispensing pump according to claim 11, wherein means facing the upper end of said piston is provided on an upper end of said plunger, extends into said chamber and is contoured complementarily to said upper end of said piston, said wall means permitting said head to continue to expel product through said discharge passage upon depression of said head after said wall means bears against said upper end of said piston at the end of the plunger downstroke, before said plunger moves into its discharge closing position.

14. The dispensing pump according to claim 12, wherein means facing the upper end of said piston is provided on an upper end of said plunger, extends into said chamber and is contoured complementarily to said upper end of said piston, said wall means permitting said head to continue to expel product through said discharge passage upon depression of said head after said wall means bears against said upper end of said piston at the end of the plunger downstroke, before said plunger moves into its discharge closing position.

* * * * *